United States Patent [19]

Hochleitner et al.

[11] Patent Number: 4,752,258

[45] Date of Patent: Jun. 21, 1988

[54] DEVICE FOR CONTROLLING A CYCLOID PROPELLER FOR WATERCRAFT

[75] Inventors: Josef Hochleitner, Herzogenaurach; Harald Gross, Bolheim, both of Fed. Rep. of Germany

[73] Assignees: Siemens Aktiengesellschaft, Berlin & Munich; J. M. Voith GmbH, Heidenheim, both of Fed. Rep. of Germany

[21] Appl. No.: 917,184

[22] Filed: Oct. 9, 1986

[30] Foreign Application Priority Data

Nov. 8, 1985 [DE] Fed. Rep. of Germany ..... 3539617

[51] Int. Cl.[4] ..... B63H 21/24

[52] U.S. Cl. ..... 440/93; 416/108

[58] Field of Search ..... 440/93; 416/108, 110, 416/111

[56] References Cited

U.S. PATENT DOCUMENTS 3,700,349 10/1972 Fork ..... 416/111

3,704,961 12/1972 Fork et al. ..... 416/111

FOREIGN PATENT DOCUMENTS 2141569 2/1973 Fed. Rep. of Germany .

7122046 10/1972 France .

7122088 10/1972 France .

*Primary Examiner*—Sherman D. Basinger

*Assistant Examiner*—Jesûs D. Sotelo

*Attorney, Agent, or Firm*—Jeffers Hoffman & Niewyk

[57] ABSTRACT

To enable an exact and quick adjustment of the control point of a cycloid propeller ("Voith-Schneider-Propeller"), hydraulic adjustment cylinders are provided with electric proportional valves whose set value is determined by a cylinder stroke control circuit—preferably by way of an auxiliary valve current control circuit and a valve position control circuit. The travel and the rudder commands are transformed, by means of incremental transmitters which limit the adjustment velocity as a function of the load and the travel direction, according to suitable characteristics to control inputs which are transformed from ship coordinates to actuator coordinates and converted according to Pythagoras' theorem to set values for the cylinder strokes.

14 Claims, 6 Drawing Sheets

DEVICE FOR CONTROLLING A CYCLOID PROPELLER FOR WATERCRAFT

BACKGROUND OF THE INVENTION

This invention relates to a device for controlling a cycloid propeller for watercraft.

In order to precisely maneuver ferry boats, floating cranes, passenger liners, buoy boats, trawlers or other watercrafts within a minimum amount of space or to keep such watercrafts exactly in one and the same spot, such crafts are preferably equipped with a plurality of cycloid propellers, generally referred to as "Voith-Schneider propellers". These prior art cycloid propellers are propeller wheels which protrude from the bottom of the craft and rotate about a generally vertical axis. A plurality of blades are arranged on the circumference of these propeller wheels and these blades pivot individually about axes which are also generally vertical. German Patent No. 2 029 995 discloses a control for these blades. The principle of operation of such prior art propeller wheels is shown in FIG. 1, of the instant application.

Referring to FIG. 1, three to seven pivoting blades 2 through 6 are arranged on the propeller wheel 1. These blades are pivoted relative to the wheel tangent through an angle which is varied over a complete revolution of the propeller wheel between a maximum positive and a maximum negative angular value (the so-called "pitch"). The propeller wheel is arranged on the bottom of the watercraft, hereinafter referred to as a ship, in such a way that its axis of rotation is substantially vertical whereby the water exerts forces K2–K6 on the pivoting blades. The vector addition of these forces produces a resultant force which increases with an increase in the angle of the pivoting blades relative to the wheel tangent.

With F marking the longitudinal axis of the ship and with points 7, 7′ marking the intersections of this axis with the circle 1, the angle f of the pivoting blades at points 7, 7′ (called "travel pitch") produces the thrust which moves the ship in the direction of the longitudinal axis F, which is the normal direction of travel of the ship.

If the position of the pivoting blades at points 8 and 9 is varied from the position shown in FIG. 1, so that a "rudder pitch" is imparted to the blades, as measured by the angular position of the pivoting blades relative to the wheel tangent at points 8 and 9, a thrust force component in the direction of the "rudder axis" R will be generated.

To adjust the position of the pivoting blades, an adjustable so-called "control point" A is provided in the propeller wheel transmission. The eccentricities of control point A relative to the propeller wheel, as measured by Cartesian components DF, DR in the coordinate system F, R, determine the pitch of the blades as the propeller wheel revolves.

The thrust forces occurring in the directions F and R which are produced by the propeller wheel and its drive depend on the flow of water which impinges on the propeller wheel. More specifically, the thrust forces are dependant on the geometry of the ship bottom and the relative speed of travel of the ship. These variables can be allowed for by the control characteristics of the propeller wheel. With respect to the loading of the drive and the limitation of the eccentricities, it has been shown to be advantageous to reduce the travel pitch as a function of the rudder pitch, as shown by characteristic 10 in FIG. 1. The control axis A of the propeller wheel transmission is adjusted with the aid of two electrically controlled actuators 11 and 12 and a driving mechanism (not illustrated). If these actuators are located in the axes F and R, the adjustment paths DX and DY equal the eccentricities DF and DR. Depending on ship type, however, the spatial conditions often require a different arrangement and movement of actuators 11 and 12, for instance in the direction of the axes X and Y in FIG. 1. To control the actuators it is thus necessary to convert the eccentricities DF and DR through a rotation of the coordinate system to control variables Dx and Dy for the adjustment paths DX and DY.

For this purpose, the transformer device 13 is employed which provides the control inputs of actuators 11 and 12. The input signals of transformer device 13 are provided by an arithmetic unit 14 and are derived from the control inputs F and R.

The control input F for the travel pitch is determined by a travel command which may be adjusted by means of a speed control lever 15 and an associated transmitter 16, while the control input R for the rudder pitch is determined by a rudder command which is adjusted by means of a rudder wheel 17 and an associated transmitter 18.

According to the aforementioned German Pat. No. 2 029 995, the mechanical forces for adjustment of the control axes are applied by servomotors which are coupled together with one another since they are jointly attached to the control point A.

It is, therefore, desired to provide a control for a propeller wheel which maintains exact control of a ship. It is further desired to provide such a control which is adapted easily to various servomotors, drive motors, ship types and propeller designs, and which requires for such adaptation only the setting of suitable electrical parameters in the electronic control system. It is still further desired to provide a simple electrical and practically maintenance-free control which achieves the same measure of safety and ruggedness as conventional, strictly mechanical controls.

SUMMARY OF THE INVENTION

The present invention overcomes the disadvantages of the above-described prior art mechanical control systems by providing an improved electrical control system therefor. The control system of the present invention, in one form thereof, provides proportional valves in a hydraulic circuit which permit continuous flow control in both directions. This permits very accurate positioning of the adjustment cylinders thereby enabling the control of considerable forces easily, exactly and quickly.

A rapid increase of the pitch increases the load on the propeller drive and the mechanism for adjustment of the pivoting blades, irrespective of the polarity of the pitch. Thus, a reduction of the pitch, that is, moving the pivoting blades towards their tangential position, represents a relief which may be performed quickly. Therefore, incremental transmitters are provided for rapid control, which transmitters continually increment or decrement the set values of the travel pitch and rudder pitch, respectively, to new values. The pitch increase speed and the pitch reduction speed are independently adjustable for the rudder pitch and the travel pitch. The limitation of the incremental velocity may be dependent on the load upon the drive, on the speed of rotation and/or the position of the rudder wheel and the speed control lever itself.

Favorably, the travel pitch is reduced as a function of the rudder pitch, specifically by means of a factor which depends on the rudder pitch. Preferably, the rudder pitch may be controlled as a function of the travel pitch, specifically as a function of the travel pitch and travel direction. If the rudder pitch and the travel pitch are limited to a value corresponding to the maximum permissible stroke of the adjustment cylinders, mechanical stops for the maximum cylinder excursion may be eliminated. The limit values are preferably set as a function of the load condition of the drive, thereby relieving the drive and its control.

Lastly, the set values generated by the arithmetic unit corresponding to the eccentricities of the control point in the ship coordinates may advantageously be transformed to eccentricities with respect to the coordinates $\underline{X}$, $\underline{Y}$. These values are coordinated with the cylinders, which are mounted so as to rotate about the vertical axes Ax, Ay. The strokes of the cylinders are computed in accordance with the geometric theorem by Pythagoras from these transformed eccentricities.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
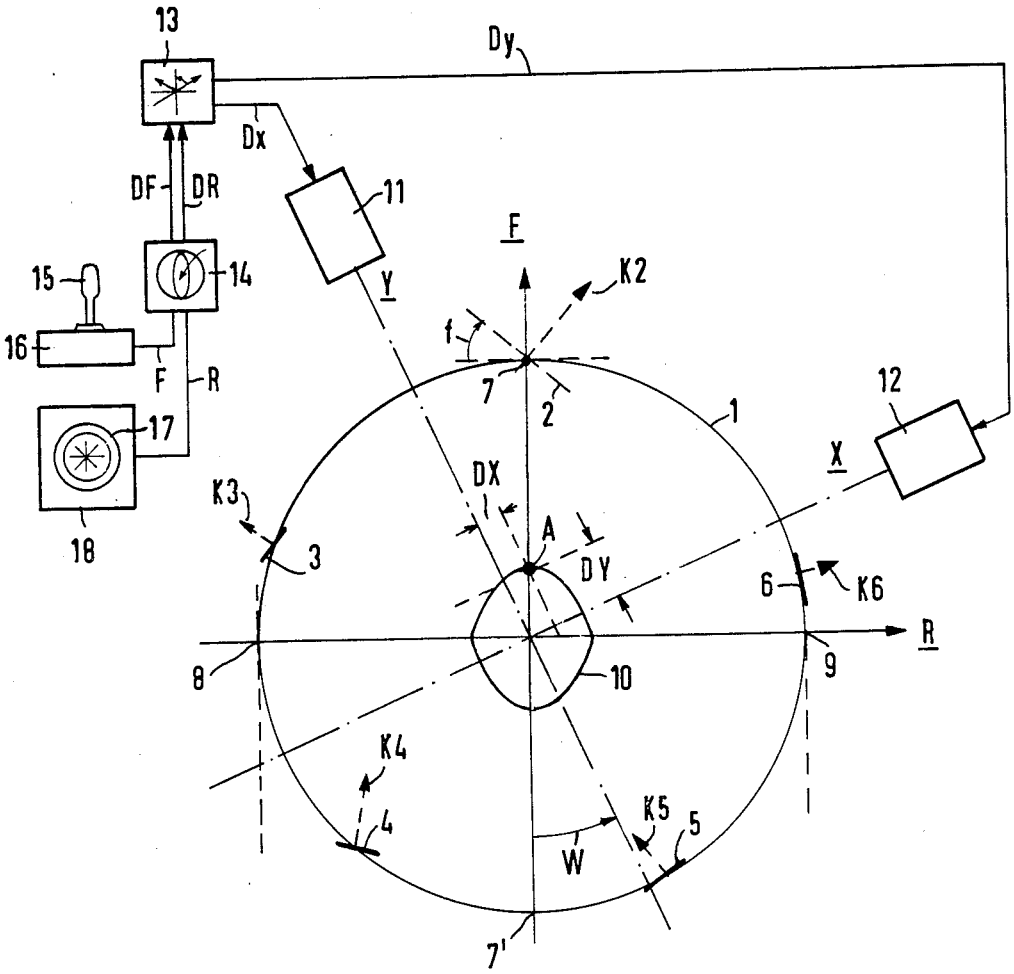
FIG. 1 is a schematic diagram of a prior art cycloid propeller control.
Figure 2:
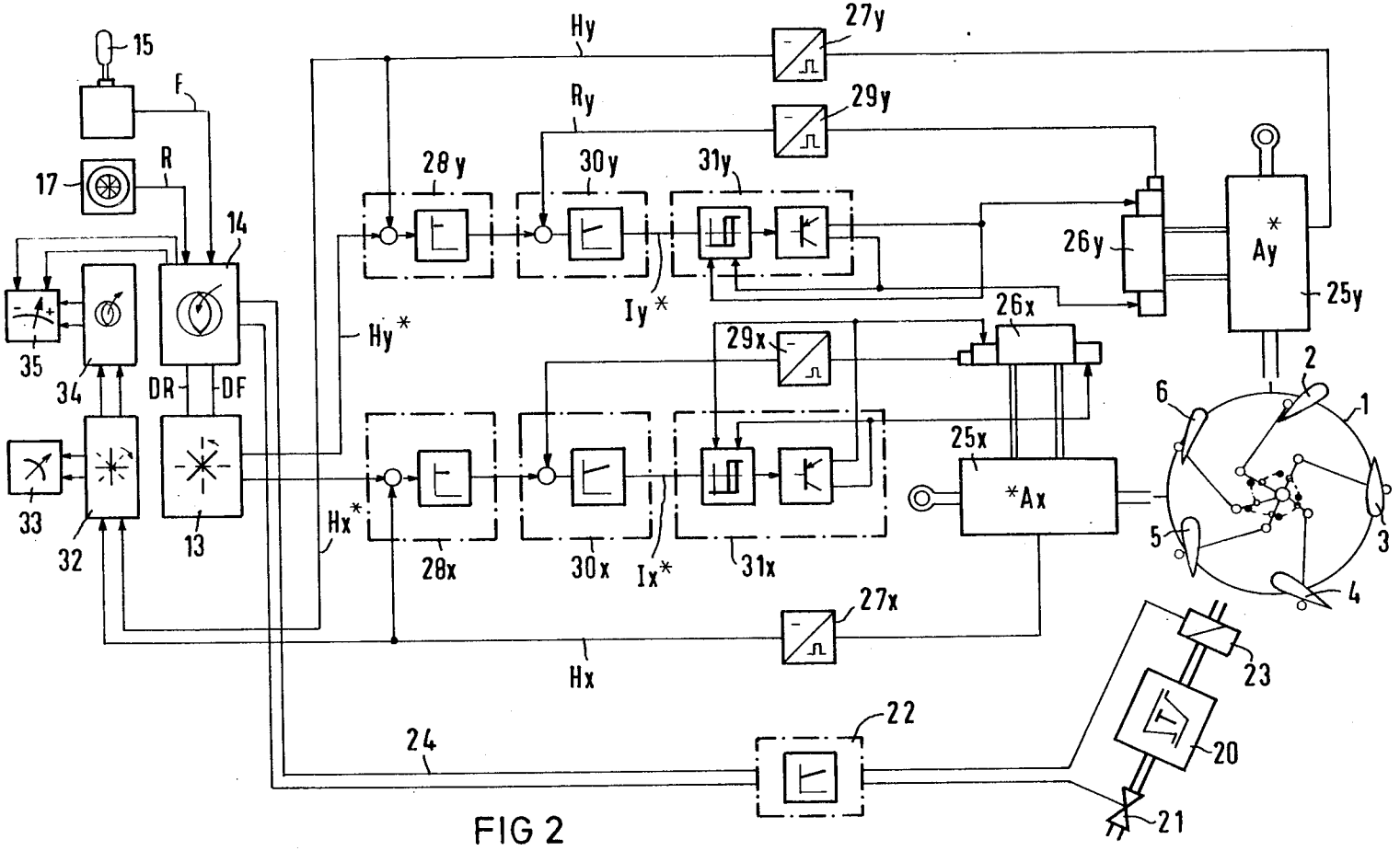
FIG. 2 is a block diagram of a control for a cycloid propeller according to the present invention.

Referring to FIG. 2, there is shown a propeller wheel 1 which is maintained at an adjustable speed of rotation by a diesel engine 20. Mostly, the speed of rotation of wheel 1, when considered within a larger operating range, is practically constant. The optimal adaptation to the respective actual operating condition is effected by way of control parameters which are adapted by type or individually.

The drive moment is predetermined by way of a suitable servocomponent, for instance, the intake valve 21 of the diesel engine 20 is provided with an input from a drive control 22 which, by way of example, may comprise a rotational speed control. A mechanical element 23 is provided for transmitting the actual speed of rotation for wheel 1 and for driving the oil pressure pumps which serve to maintain the pressure in the preferably separate lubricating and control oil circuits of the propeller wheel. Mechanical element 23 may also include a clutch.

The load condition of the drive which, in the shown embodiment, is established by the charging degree of the diesel engine 20 as adjusted by means of the intake valve 21, may influence the pitch control by way of connecting control lines 24. The drive control may also be influenced by the set and actual values of the pitches so that the drive may, for instance, be started only when the blades 2–6 are tangentially arranged with the rudder wheel 1 with no thrust and rudder forces acting on the propeller wheel 1.

Adjustment cylinders 25*x*, 25*y* are used for adjustment of the control axes. Electrohydraulic proportional valves 26*x* and 26*y* are used directly in the control hydraulic circuit. These valves permit a continuous, very precise adjustment in both directions of the respective strokes of the two adjustment cylinders 25*x* and 25*y*. The adjustment cylinders themselves pivot, by way of example, about lock Ax, Ay, with the cylinder strokes required for the position of point A resulting from the spacing of point A from Ax and Ay in accordance with the Pythagorian theorem.

Adjustment cylinders 25*x* and 25*y* provide actual value outputs from which actual values Hx, Hy for the cylinder stroke are derived by means of transducers 27*x* and 27*y*. Actual values Hx and Hy, together with corresponding set values Hx*, Hy*, are transmitted respectively to cylinder stroke controls 28*x*, 28*y* of a cylinder stroke control circuit which derives therefrom the set values Ix*, Iy* for the flow of valves 26*x*, 26*y*.

The cylinder stroke control circuit is also provided with an auxiliary valve displacement circuit. The actual values of the valve positions are derived from an actual value output of each valve 26*x*, 26*y* by a pair of measured value transducers 29*x*, 29*y*. These values are transmitted to a valve displacement control 30*x*, 30*y*, along with the output of the cylinder stroke control 28*x*, 28*y*. The output of the auxiliary valve displacement circuit generates the current set values Ix*, Iy* which, in turn, are respectively transmitted to a valve current control 31*x*, 31*y* of a closed auxiliary valve current control loop.

To generate the current set values Hx*, Hy* which control the adjustment cylinders 25*x*, 25*y*, the travel command F as selected by the travel lever 15 and the rudder command R as selected by the rudder wheel 17 are converted by the arithmetic unit 14 to set values DF and DR for the travel pitch and the rudder pitch, respectively. Values DF and DR correspond to the eccentricities of the control point A in the ship coordinate system $\underline{F}$, $\underline{R}$. Transformer device 13 serves to convert the values DF and DR to coordinates $\underline{X}$, $\underline{Y}$ of actuators 25*x* and 25*y*. The design of transformer device 13 and arithmetic unit 14 will be explained hereinbelow.

Provision is also made for transmitting the actual stroke values Hx, Hy to an actual value transformer 32 which operates inversely to the transformer device 13 so as to show on a display 33 the retraced actual values of rudder pitch and travel pitch. The actual value transformer 32 is preferably connected in circuit with an actual value arithmetic unit 34 which operates inversely to the arithmetic unit 14 and generates retraced actual values for the control inputs of travel pitch and rudder pitch. For instance, if the drive of the ship has stabilized to a steady state condition, an equalization display 35 indicates the equality of the retraced actual values and values corresponding to the travel command F and the rudder command R, with the display 33 then showing the actual positions of the pivoting blades. This is especially advantageous when the control lever 15 and the rudder wheel 17 are shut off in order to change over to remote control, for instance, for a convoy of several ships or to manual control of the control point A.

Due to the spatial arrangement of the actuators 25x and 25y, the angle w between the axes X, Y of the actuators and ship axes R, F is fixed for each type of ship. For that purpose, it may be necessary to change over from a right-hand system of ship coordinates to a left-hand system of X, Y system of coordinates, which may be predetermined by a parameter BX or BY for the polarity change of the X- or Y- coordinate. The transformation of coordinates then transforms the set values DR and DF to eccentricities DX, DY according to the equations:

$$DX=BX\,(DR\cdot\cos w+DF\cdot\sin w)$$

$$DY=BY\,(-DR\cdot\sin w+DF\cdot\cos w).$$

So-called "vector rotators" or "vector turners" are known in the prior art for such transformations. In the transformer device 13, an appropriate arithmetic unit 36 (FIG. 3) is connected in series with another arithmetic unit element 37 which, according to the geometric theorem by Pythagoras, computes the respective adjustment cylinder stroke current set values Hx*, Hy* from the eccentricities. When defining the spacing of the pivotal axes Ax, Ay of the adjustment cylinders from the coordinate intersection as respectively ax, ay, the resulting relation for the arithmetic unit element 37 in FIG. 3 will be:

$$(ax+Hx^*)^2=(ax+DX)^2+DY^2$$

$$(ay+Hy^*)^2=(ay+DY)^2+DX^2$$

Figure 3:
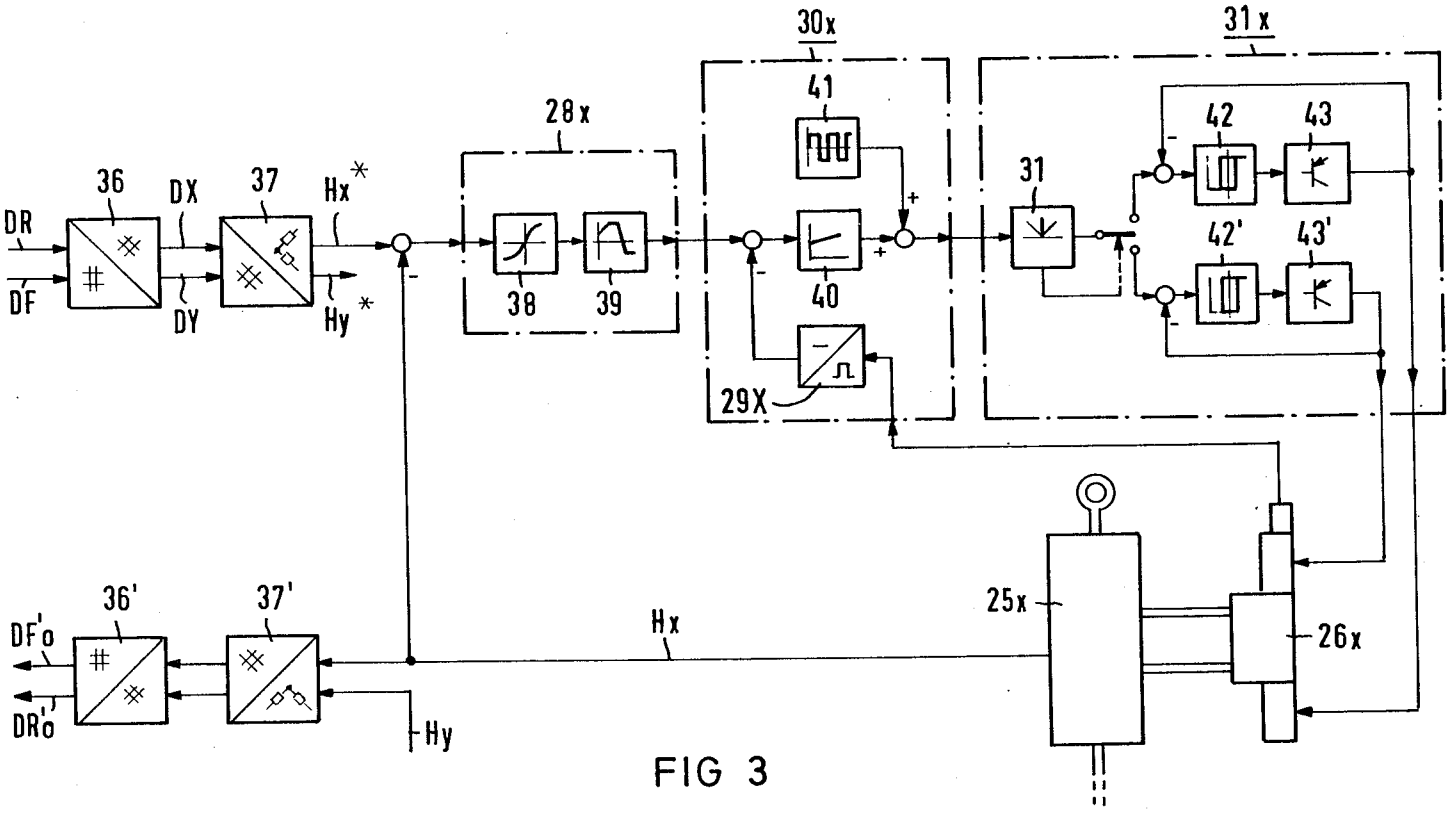
FIG. 3 is a block diagram of a control according to the present invention for determining the set values for travel pitch and rudder pitch.

As shown in FIG. 3, a corresponding inverse arithmetic element 37' and an inverse vector turner 36' generate from the cylinder stroke actual values Hx, Hy two retraced actual values DFo', DRo' of the rudder pitch and the travel pitch.

The further processing of the control signals for the actuators, that is, of the stroke set values Hx*, Hy*, is shown in FIG. 3 only for the actuator 25x. A proportional control is used as stroke control 28x. To avoid any overshoot, the amplification factor is adjusted to be nonlinear by a characteristic member 38. This makes it possible to predetermine the velocity of cylinder adjustment, and in particular, to make the velocity approximately proportional to the root of the control variation. To prevent the electrically adjustable valve control lever from performing jerky motions which would result in large pressure changes, an incremental transmitter 39 is connected in series with the characteristic member 38.

The auxiliary valve displacement control 30x preferably displays a PI, (proportional and integral action) behavior. Superimposed on its output signal is a square wave oscillation which is generated as "valve current oscillation" by an additional set value transmitter 41. Accomplished thereby is a continuous slight motion of the valve control lever and thus a reduction of static friction in the proportional valve 26x.

The series connected valve current control 31x is designed as a two-point control. The valve current set value is rectified to that end element 31 and, in accordance with its polarity, i.e., the desired increase or reduction of the cylinder stroke, is transmitted to a separate control channel which is coordinated with the respective direction of flow of the control oil through the adjustment cylinder 25x and proportional valve 26x. Each control channel comprises a threshold value member 42, 42' which activates a switching transistor 43, 43' for the valve current.

Figure 4:
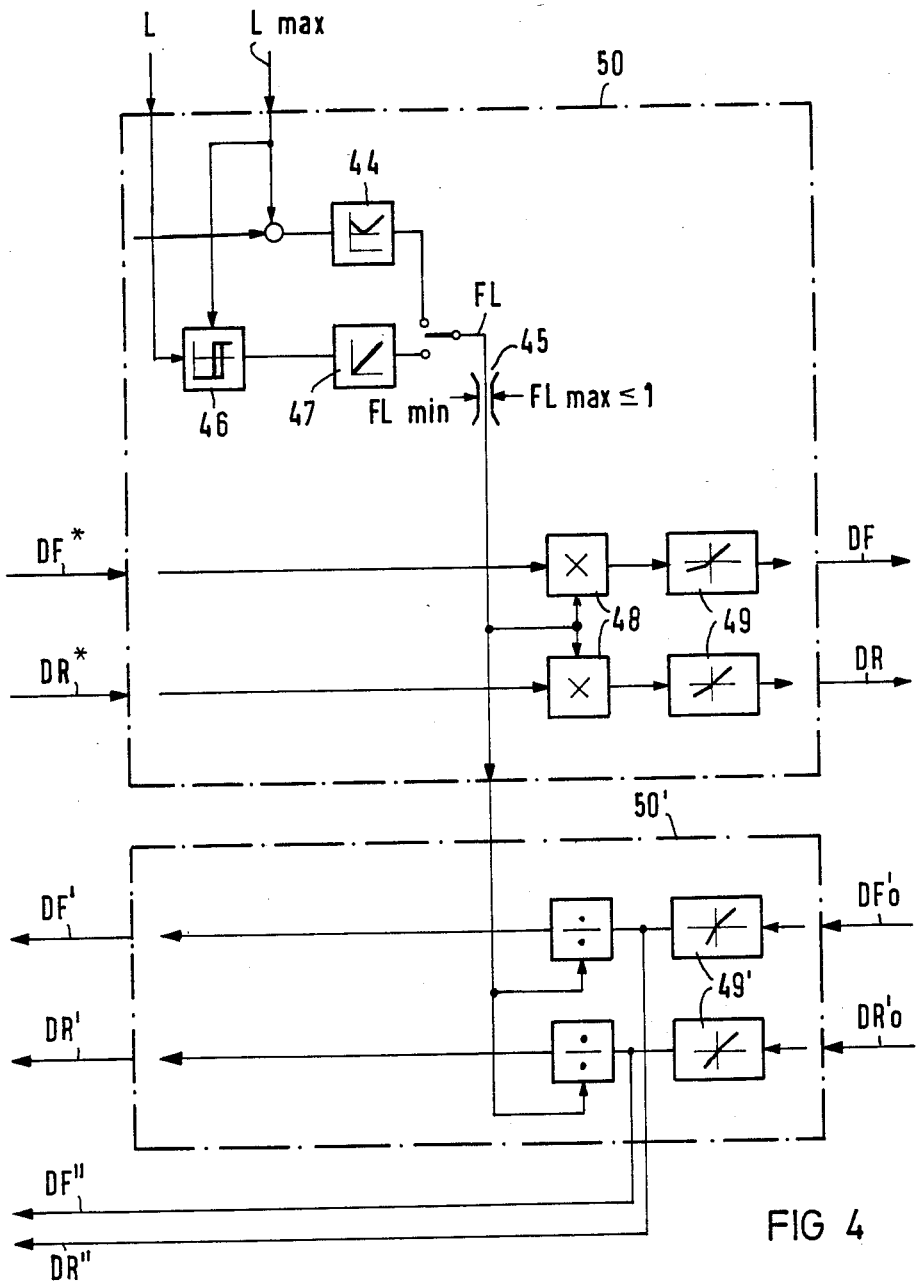
FIG. 4 is a block diagram of a limiting circuit for determining a load dependant set value limitation.

The rudder pitch and the travel pitch, that is, the eccentricities of the control point A, may be limited to a value which is dependant on the load condition of the drive. To this end there is provided the limiter circuit of FIG. 4, comprising a limiting control and which presets a limit value for both the travel pitch and the rudder pitch, which values may differ for positive and negative pitches. Depending on the load condition of the drive 20, this arrangement avoids overloading, and the control of the pivoting blades may be adapted in a flexible way to the particular ship and drive types.

For instance, the degree at which the engine is charged, that is, the setting of the intake valve 21, may be predetermined as a load condition actual value by way of connecting line 24. If an analog value is used, the variation from the permitted maximum load Lmax may be transmitted to an analog control, preferably one with an integral and differentiating portion e.g. proportional and integral action control 44 with time differentiating behaviour of the first order whose output signal FL is limited by a limiting circuit 45 to a maximum value FLmax for which a value of 1 is maximally preset. The minimum value is limited as well to an adjusted value FLmin, for instance FLmin=½. As long as the actual value L does not reach the limit value Lmax, the control output signal FL continues to rise until it assumes the value FLmax. If Lmax is exceeded, then FL is continuously reduced until either the load maximum value FLmax is maintained or the FLmin value is reached.

However, when using a digital actual value L, a two-point control such as threshold value member 46 with threshold value Lmax may be used whose output signal is transmitted as a polarity signal to an integrator 47. The integrator output signal rises or drops depending on the predetermined polarity, at constant pitch, until either FLmax or FLmin is reached, or the output signal FL fluctuates around the value Lmax.

The output signal FL is provided to multipliers 48 as a factor for the output signal DF and DR of the characteristic member 14. The products may additionally be transmitted to characteristic members 49 for individual adaptation of the particular drive types. By way of example, provision may be made so that, at maximum load or at FL=1, the actual travel pitch DF for forward travel is limited to 95%, but for reverse travel to 80% of the travel pitch which is selected by DF*. Independently thereof, maximum values may also be set for the rudder pitch, for both polarities of the pitch.

An inverse arithmetic unit member 50' is provided which corresponds to the load-dependant limiting circuit 50 and calculates two retraced set values DR', DF' of the rudder pitch and travel pitch. Member 50', inversely to the characteristic members 49, compensates by means of characteristic members 49' for the maximum pitch and, by division by the factor FL, for the effect of the multipliers 48.

Moreover, additional outputs are provided on which retraced values DF", DR" of the travel pitch and the rudder pitch, corrected only by the maximum pitch, can be tapped.

Figure 5:
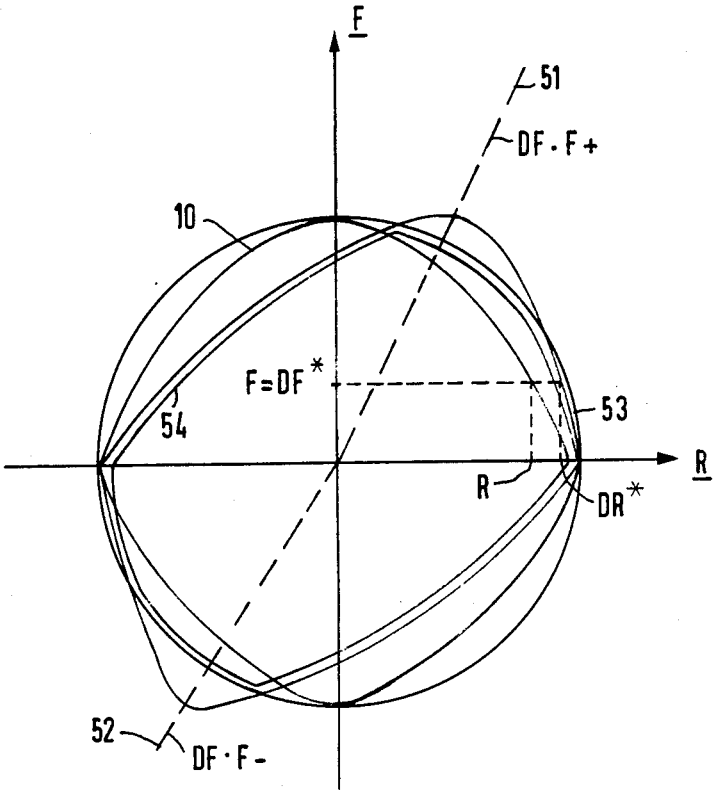
FIG. 5 is a modified control diagram for the set values.

The above-mentioned prior art suggested the generation from the travel command F of a corresponding travel pitch or eccentricity as a function of the rudder pitch according to an elliptical characteristic. For instance, with one propeller wheel provided on the bow and one or two juxtaposed propeller wheels at the stern of the ship, the water will approach the respective propeller wheels in a direction which, depending on the type of ship, varies from the longitudinal axis F of the ship as a function of travel speed and travel direction, that is, the magnitude and polarity of the travel pitch. To achieve a desired thrust in the R direction, different rudder pitches are thus required for different ships and which are allowed for by a characteristic shift. FIG. 5 shows a new, preferred characteristic 10 which, for instance for the travel pitch, produces a value DF* (F, R) which is dependant on the control inputs F and R. To bring about a characteristic linear shift, the rudder pitch, depending on whether the travel thrust is directed forwardly or rearwardly, is shifted relative to the characteristic 10 by a value DF*·F+(straight line 51) or DF*·F− (straight line 52), thus resulting in the eccentricity DR* as shown by the following equations:

$$DR^*=R+DF^*\cdot F+$$

$$DR^*=R+DF^*\cdot F$$

However, the mechanism for adjustment of control point A permits only a limited maximum deflection about the center point, which is indicated by the circle 53 in FIG. 5 and given by the condition:

$$DF^{*2}+DR^{*2}\leqq \text{const.}$$

Consequently, the arithmetic unit 14 determines from the commands F and R, which are given as control inputs, the pitches DF* and DR* which are within the limit curve 54. According to FIG. 6, this diagram shift is achieved by means of an appropriate characteristic member 55 in the arithmetic unit 14. For the retraced set values DF' and DR', the actual value arithmetic unit 34 contains a correpsonding inverse characteristic member 55', whereas the values DF" and DR" are retraced by the inverse characteristic member 55". With the changeover switch 58 in the proper position, the displays 57 will then show to which retraced eccentricities in shift coordinates the momentarily existing cylinder strokes correspond. In the event of failure of the arithmetic unit 14, the relay 58" responds and repositions the changeover switch 58 so that the displays 57 will then show the actual cylinder strokes in the respective coordinates turned by the angle w.

The control inputs F and R are converted in the arithmetic unit 14 by a characteristic member 56 according to the relation:

$$DF^*=F\cdot N$$

with N being given by the function:

$$N=(1-M|R|^B)$$

with adjustable parameters M and B.

Another favorable characteristic is also based on such a factor N but which equates the travel pitch DF* with the travel command F as long as the value of F is smaller than or equal to the factor N. When this condition does not hold, the relationship:

$$\begin{aligned} DF^* &= +N, \text{ if the sign of } F \text{ is positive} \\ &= -N, \text{ if the sign of } F \text{ is negative} \end{aligned}$$

is used. The characteristic member may be of a design such that a selective changeover is possible between the two characteristic forms, in which context it may be suitable, simultaneously with the changeover to the other characteristic form, to also change over to a different parameter set in the other components of the control.

Corresponding to the characteristic member 56 in the arithmetic unit 14 is the inverse characteristic member 56' in the actual value arithmetic unit 34 for calculating retraced commands R', F' from the stroke actual values. Once the control has assumed a stationary condition, the retraced commands F' and R' tapped at the actual value arithmetic unit 34, are then equal to the commands set on the control lever 15 and on the rudder wheel 17. This balanced condition may be seen on the mentioned equalization display 35 (FIG. 2) for releasing the changeover to a remote control or to an on-site manual control. This changeover may be effected by a selector switch 59. This selector switch also makes it possible to transmit the retraced commands to the input of the control so as to make the incremental transmitter of the control follow the actual values during manual operation when the controls are not engaged.

To avoid sudden adjustments of the pivoting blades and the associated load peaks on the drive, an incremental transmitter is suitable for each of the control inputs F and R of the rudder pitch and the travel pitch in order to limit the adjustment velocity at rapid changes of the travel command and the rudder command. The adjustment speed then is not a constant value but changes with the magnitude of the respective component. The adjustment speed may also depend on the direction of change, that is, for an incrementation away from the zero point or a decrementation to the zero point. Since the control oil pump is coupled to the drive, a dependence of the adjustment velocity on the speed of rotation is suitable as well. Additionally, the incremental speed can be reduced as a function of the load on the drive so as to avoid overloading the drive engine.

Figure 6:
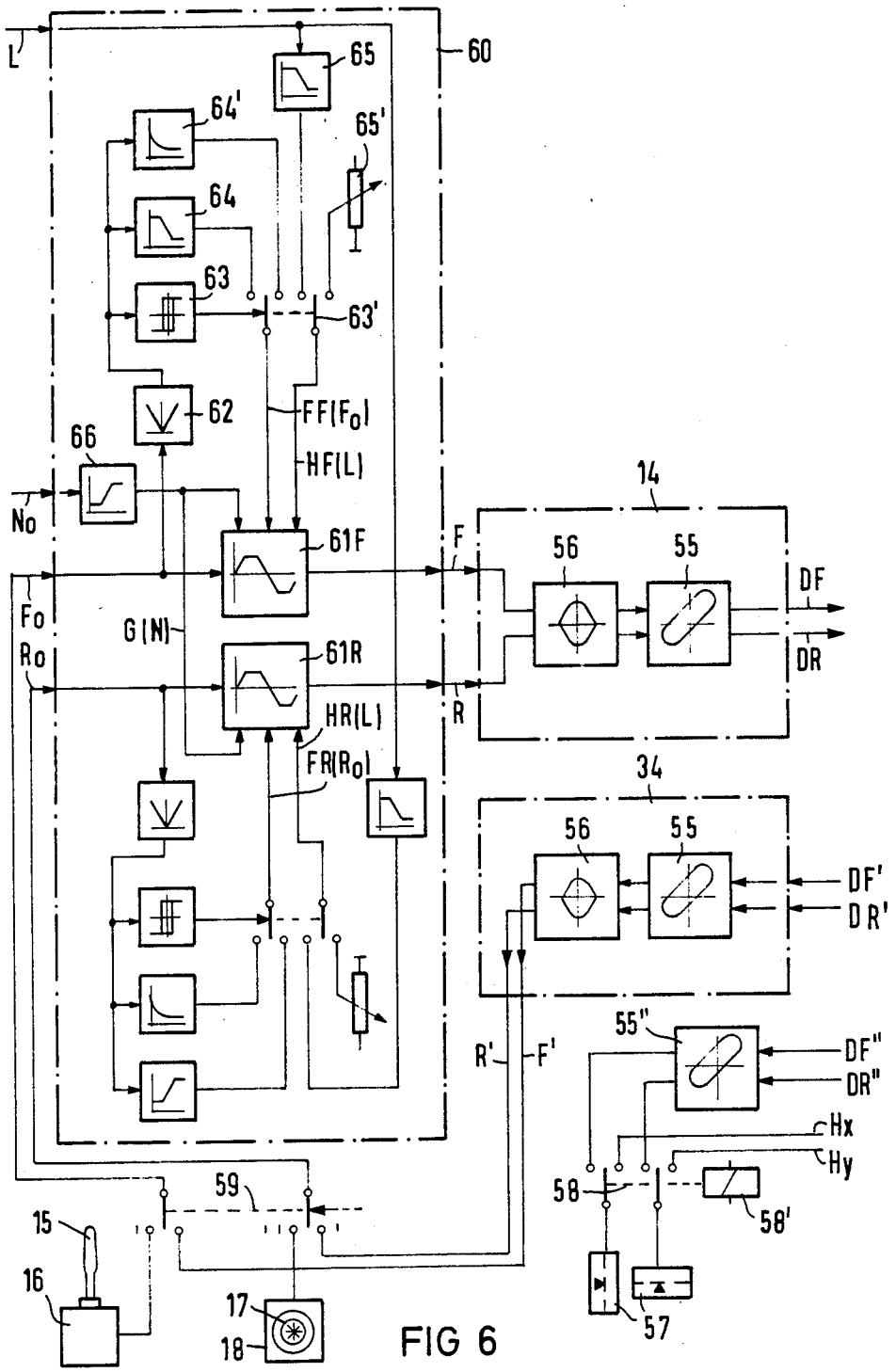
FIG. 6 is a block diagram of a control for the generation of set values for travel pitch and rudder pitch from the travel and the rudder commands.

According to FIG. 6, the input of the arithmetic unit 14 is, therefore, provided with a circuit 60 for limiting the adjustment velocity, which circuit contains an incremental transmitter 61F and 61R so as to continually increment the travel pitch F or the rudder pitch R to a new value when the travel command or the rudder command, respectively, are changed. The velocity of change of pitch increase and decrease is preferably adjustable independently for the rudder pitch or the travel pitch, respectively.

As illustrated in FIG. 6, the rate of change VF of the control input F for the travel pitch is preset on the incremental transmitter 61F to a constant value VFo which, for instance, is adjusted to the propeller size and can be corrected as a function of the travel pitch, its direction of change, load condition L, and the speed of rotation No of the engine or the control oil pump, respectively. The determination of the travel pitch is generated by a mangitude generator 62 for the control input F or for a control signal Fo tapped at the lever 15, respectively whereas a detector 63 determines the direction of change, that is, the differentiation between pitch increase and pitch decrease according to whether $(d|F|/dt)$ is a positive or negative value.

A changeover switch 63' which is activated by the detector 63 permits changeover, dependent on direction, between two characteristic transmitters 64, 64'. The adjustment of the correcting function FF(Fo) is dependent on the travel pitch and its direction of change, preferably a polygonal course. The changeover switch and two characteristic transmitters 65, 65' also permit adjustment based on a load-dependent correction function HF(L), whereby a decrease in pitch can be effected swiftly and also independently from the output, so that in the characteristic transmitter 65' which is activated when $d|Fo|/dt<0$ the value "1" can be set as a constant.

A characteristic transmitter 66 which is activated by the speed of rotation No additionally produces a correction function G(No) so that the incremental transmitter determines the velocity of change VF of the control input F according to the relation:

$$VF=VFo\cdot FF(Fo)\cdot G(No)\cdot HF(L)$$

Similarly, for the control input R of the rudder pitch which is generated according to the signal Ro of the rudder wheel 17, the functions FR(Ro) and HR(L) are generated by respective characteristic transmitters in conjunction with an appropriate detector, which functions provide from the preset incremental velocity VRo the velocity of change VR of the control input R according to the relation:

$$VR=VRo\cdot FR(Ro)\cdot G(No)\cdot HR(L).$$

The invention thus provides a control for the control point A of a cycloid propeller which by simple adjustment of the individual parameters and characteristics can be adapted to different ship types and requirements. The control is rugged, nearly free of maintenance, and easy to operate.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a watercraft including a drive mechanism and a cycloid propeller coupled thereto, a control for controlling said propeller comprising:

(a) a hydraulic circuit including two hydraulic adjustment cylinders having pistons therein, each said cylinder being mounted so as to be rotatable about a separate, substantially vertical axis, at least two electrohydraulic proportional valves for respectively connecting said cylinders in a hydraulic circuit, the pistons of said cylinders being secured to a shiftable joint control point for determining the position of the control point;

(b) means for adjusting the pitches of the pivoting blades of the propeller as a function of the eccentricities of the control point such that the pivoting blades exhibit a travel pitch producing a thrust force component in the direction of the longitudinal axis of the watercraft, and exhibit a rudder pitch producing a thrust force component in the direction of the rudder axis of the watercraft generally perpendicular to the longitudinal axis thereof;

(c) a first arithmetic unit for generating from a travel command and a rudder command respective pitch set values for the travel pitch and rudder pitch as a function of ship coordinates;

(d) transformer means for generating eccentricities from said pitch set values as a function of the adjustment of the adjustment cylinders;

(e) a second arithmetic unit for calculating from said generated eccentricities stroke set values for the adjustment cylinders;

(f) at least one measuring unit for determining the actual values of the stroke of each cylinder; and (g) at least one cylinder stroke control circuits respectively coordinated with said cylinders for each generating, from the respective stroke set value and the cylinder stroke actual value, a valve current set value, said stroke control circuits each including control means for continuously changing the flow through said electrohydraulic proportional valves in accordance with said valve current set value.

2. The apparatus according to claim 1, characterized in that said first arithmetic unit includes a first characteristic member which, from a control input F derived from the travel command, a variable R for determining the rudder pitch, and from adjustable parameters M and B generates a set value DF for the travel pitch according to the relation $DF=F\cdot(1-M|R|^B)$.

3. The apparatus according to claim 1, characterized in that said first arithmetic unit includes a first characteristic member which, from a control input F derived from the travel command, from a control input R derived from the rudder command and from adjustable parameters M and B determines the set value DF for the travel pitch according to the relation $DF=F$, if $|F|\leqq N$, $DF=+N$, if $|F|>N$ and the sign of F is positive, and $DF=-N$, if $|F|>N$ and the sign of F is negative, where $N=(1-M|R|^B)$.

4. The apparatus according to claim 1, characterized in that said travel command includes control inputs for both said travel pitch and a travel direction, and said first arithmetic unit includes a second characteristic member which controls the rudder pitch as a function of said travel command.

5. The apparatus according to claim 1, characterized in that said first arithmetic unit includes at least two incremental transmitters which, as a function of a change of the travel command and a change of the rudder command, continuously generate a control input for the travel pitch and the rudder pitch, the velocity of change of the control input being independently adjustable for an increase in pitch and a decrease in pitch.

6. The apparatus according to claim 5, characterized in that said incremental transmitters are respectively connected to inputs of the first arithmetic unit and generate control inputs from the travel command Fo and the rudder command Ro, the velocities of change VF and VR of said control inputs being determined according to the relations:

$$VF = VFo\ FF(Fo)\ G(N)\ HF(L)$$

$$VR = VRo\ FR(Fo)\ G(N)\ HR(L).$$

where VFo, VRo are constant parameters, and where FF(Fo) and FR(Ro) are functions which are dependent on the value and polarity of Fo and Ro, respectively, where G(N) is a function which is dependent upon the speed of rotation of the propeller, and where HF(L) and HR(L) are functions which are dependent on the load condition of the drive so that HF(L)=1 and HR(L)=1, respectively, for a reduction of the travel pitch or rudder pitch, respectively.

7. The apparatus according to claim 1, characterized in that the pitch set values for the rudder pitch and the travel pitch are each limited to a value which equals the maximum permissible stroke of the adjustment cylinders.

8. The apparatus according to claim 7, characterized in that the pitch set values are each further limited to a value which is dependent on the load condition of the drive.

9. The apparatus according to claim 1, including a limiting circuit which limits the pitch set values each to a value predetermined by the output signal of a limiting control, said limiting control being activated by an input variable corresponding to the load condition of the drive.

10. The apparatus according to claim 1, characterized in that said stroke actual values are transmitted also to an actual value transformer member which operates inversely to said transformer means and to said first arithmetic unit, and which generates retraced actual values for the rudder pitch and the travel pitch.

11. The apparatus according to claim 10, characterized in that said actual value transformer member is connected to an actual value arithmetic unit which operates inversely to said first arithmetic unit, for generating retraced actual values for the control inputs of travel pitch and rudder pitch.

12. The apparatus according to claim 1, characterized in that each cylinder stroke control circuit includes a nonlinear proportional amplifier and an incremental transmitter.

13. The apparatus according to claim 1, characterized in that a valve displacement control circuit with a proportional and integral action control is provided for each cylinder stroke control circuit, the output signal of said control being superimposed by an alternating valve current set value of addition.

14. The apparatus according to claim 1, characterized in that each valve current set value is transmitted to an auxiliary control circuit for generating current to operate said respective electrohydraulic proportional valve.

* * * * *

UNITED STATES PATENT AND TRADEMARK OFFICE

CERTIFICATE OF CORRECTION

PATENT NO. : 4,752,258

DATED : June 21, 1988

INVENTOR(S) : Jcsef Hochleitner

It is certified that error appears in the above-identified patent and that said Letters Patent is hereby corrected as shown below:

Col. 7, line 33, change "DR*=R+DF*.F" to -- DR* = R + DF* . F - --
Claim 1, Col. 10, line 21, change "one" to --two--.

Signed and Sealed this

Tenth Day of January, 1989

*Attest:*

DONALD J. QUIGG

*Attesting Officer*

*Commissioner of Patents and Trademarks*